US009232337B2

(12) United States Patent
Greff et al.

(10) Patent No.: US 9,232,337 B2
(45) Date of Patent: Jan. 5, 2016

(54) METHOD FOR VISUALIZING THE DIRECTIONAL SOUND ACTIVITY OF A MULTICHANNEL AUDIO SIGNAL

(71) Applicants: Raphaël Nicolas Greff, Loos (FR); Hong Cong Tuyen Pham, Croix (FR)

(72) Inventors: Raphaël Nicolas Greff, Loos (FR); Hong Cong Tuyen Pham, Croix (FR)

(73) Assignee: A-VOLUTE, Roubaix (FR)

( * ) Notice: Subject to any disclaimer, the term of this patent is extended or adjusted under 35 U.S.C. 154(b) by 414 days.

(21) Appl. No.: 13/722,706

(22) Filed: Dec. 20, 2012

(65) Prior Publication Data

US 2014/0177844 A1 Jun. 26, 2014

(51) Int. Cl.
*H04S 7/00* (2006.01)
*H04R 5/02* (2006.01)

(52) U.S. Cl.
CPC ... *H04S 7/40* (2013.01); *H04R 5/02* (2013.01)

(58) Field of Classification Search
USPC ..... 381/17, 80, 306; 348/14.08, 552; 701/4; 704/500
See application file for complete search history.

(56) References Cited

U.S. PATENT DOCUMENTS

| | | | | |
|---|---|---|---|---|
| 8,175,288 | B2 * | 5/2012 | Lengeling | G10H 1/20 381/80 |
| 2007/0211170 | A1 * | 9/2007 | Ramaswamy et al. | 348/552 |
| 2009/0182564 | A1 | 7/2009 | Beack et al. | |
| 2009/0296954 | A1 * | 12/2009 | Hooley et al. | 381/80 |
| 2011/0050842 | A1 * | 3/2011 | Saleh et al. | 348/14.08 |
| 2013/0294618 | A1 * | 11/2013 | Lyubachev | H04S 7/303 381/80 |

FOREIGN PATENT DOCUMENTS

WO WO-2010075634 7/2010

OTHER PUBLICATIONS

Collins, Karen , et al., "Visualized sound effect icons for improved multimedia accesibility: A Pilot study", Entertainment Computing 3, (Sep. 28, 2011), 11-17.
Flux, "Pure Analyzer System User Manual", Flux sound and picture development, (Copyright 2012), 125 Pages.

(Continued)

*Primary Examiner* — M D S Elahee
(74) *Attorney, Agent, or Firm* — Blakely Sokoloff Taylor & Zafman LLP

(57) ABSTRACT

The invention relates to a method for visualizing a directional sound activity of a multichannel audio signal, comprising:

receiving input audio channels, spatial information being associated with each one of said channel, performing a time-frequency transformation of said input audio channels, for each one of a plurality of frequency sub-bands, determining a directional sound activity vector from said transformed input audio channels, determining a contribution of each one of said directional sound activity vectors within sub-divisions of space on the basis of directivity information related to each sub-divisions of space, for each sub-division of space, determining directional sound activity level within said sub-division of space by summing said contributions within said sub-division of space, displaying a visualization of the directional sound activity of the multichannel audio signal by a graphical representation of directional sound activity level within said sub-division of space.

15 Claims, 3 Drawing Sheets

(56) References Cited

OTHER PUBLICATIONS

Goodwin, Michael M., et al., "A frequency-domain framework for spatial audio coding based on universal spatial cues", Convention Paper 6751, Presented at the 120th Convention, Paris, France, (May 20-23, 2006), 12 Pages.

ITU-R, et al., "Multichannel stereophonic sound system with and without accompanying picture", International Telecommunications Union, (2006), 13 Pages.

* cited by examiner

METHOD FOR VISUALIZING THE DIRECTIONAL SOUND ACTIVITY OF A MULTICHANNEL AUDIO SIGNAL

CROSS-REFERENCE TO RELATED APPLICATIONS

Not applicable

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

BACKGROUND OF THE INVENTION

The invention relates to a method and apparatus for visualizing the directional sound activity of a multichannel audio signal.

Audio is an important medium for conveying any kind of information, especially sound direction information. Indeed, the human auditory system is more effective than the visual system for surveillance tasks. Thanks to the development of multichannel audio format, spatialization has become a common feature in all domains of audio: movies, video games, virtual reality, music, etc. For instance, when playing a First Person Shooting (FPS) game using a multichannel sound system (5.1 or 7.1 surround sound), it is possible to localize enemies thanks to their sounds.

Typically, such sounds are mixed onto multiple audio channels, wherein each channel is fed to a dedicated loudspeaker. Distribution of a sound to the different channels is adapted to the configuration of the dedicated playback system (positions of the loudspeakers), so as to reproduce the intended directionality of said sound.

Multichannel audio streams thus require to be played back over suitable loudspeaker layouts. For instance, each of the channels of a five channel formatted audio signal is associated with its corresponding loudspeaker within a five loudspeaker array. FIG. 1 shows an example of a five channel loudspeaker layout recommended by the International Telecommunication Union (ITU), with a left loudspeaker L, right loudspeaker R, center loudspeaker C, surround left loudspeaker LS and surround right loudspeaker RS, arranged around a recommended listener's position P. With this recommended listener's position P as a center, the relative angular distances between the central directions of the loudspeakers are indicated.

If multichannel audio is played back over an appropriate sound system, i.e. with the required number of loudspeakers and correct angular distances between them, a normal hearing listener is able to detect the location of the sound sources that compose the multichannel audio mix. However, should the sound system exhibit inappropriate features, such as too few loudspeakers, or an inaccurate angular distance thereof, the directional information of the audio content may not be delivered properly to the listener. This is especially the case when sound is played back over headphones.

As a consequence, there is in this case a loss of information since the multichannel audio signal conveys sound direction information through the respective sound levels of the channels, but such information cannot be delivered to the user.

Accordingly, there is a need for conveying to the user the sound direction information encoded in the multichannel audio signal.

Some methods have been provided for conveying directional information related to sound through the visual modality. However, these methods were often a mere juxtaposition of volume meters, each dedicated to a particular loudspeaker, and thus unable to render precisely the simultaneous predominant direction of the sounds that compose the multichannel audio mix except in the case of one unique virtual sound source whose direction coincides with a loudspeaker direction. Other methods intended to more precisely display sound locations are so complicated that they reveal themselves inadequate since sound directions cannot be readily derived by a user.

For example, U.S. patent application US 2009/0182564 describes a method wherein sound power level of each channel is displayed, or alternatively wherein position and power level of elementary sound components are displayed.

SUMMARY OF THE INVENTION

The method and system according to the invention is intended to provide a simple and clear visualization of sound activity in any direction.

In accordance with a first aspect of the present invention, this object is achieved by a method for visualizing a directional sound activity of a multichannel audio signal, comprising:

- receiving input audio channels, spatial information being associated with each one of said channel,
- performing a time-frequency transformation of said input audio channels,
- for each one of a plurality of frequency sub-bands, determining a directional sound activity vector from said transformed input audio channels,
- determining a contribution of each one of said directional sound activity vectors within sub-divisions of space on the basis of directivity information related to each sub-divisions of space,
- for each sub-division of space, determining directional sound activity level within said sub-division of space by summing said contributions within said sub-division of space, and
- displaying a visualization of the directional sound activity of the multichannel audio signal by a graphical representation of directional sound activity level within said sub-division of space.

Preferably, for determining the contribution of each one of said directional sound activity vectors within sub-divisions of space, a norm of a directional sound activity vector is weighted on the basis of an angular distance between a direction associated with a sub-division of space and the direction of said directional sound activity vector, and for each sub-division of space, directional sound activity level within said sub-division of space is determined by summing the weighted norms of said directional sound activity vectors.

Preferably, determining the directional sound activity vector for a frequency sub-band comprises:

- for each channel, determining a sound activity level for said frequency sub-band from the transformed input audio channel,
- for each channel, determining a sound activity vector related to said channel from the sound activity level and spatial information associated with said channel and, combining the sound activity vectors related to the channels for said frequency sub-band to obtain the directional sound activity vector related to said frequency sub-band.

In accordance with a second aspect of the present invention, there is provided a non-transitory tangible computer-readable medium having computer executable instructions embodied thereon that, when executed by a computer, perform the method according to the first aspect.

In accordance with a third aspect of the present invention, there is provided an apparatus for visualizing a directional sound activity of a multichannel audio signal, comprising:

a directional sound analyzing unit, comprising means for
- receiving input audio channels, spatial information being associated with each one of said channel,
- performing a time-frequency transformation of said input audio channels,
- for each one of a plurality of frequency sub-bands, determining a directional sound activity vector from said transformed input audio channels,
- determining a contribution of each one of said directional sound activity vectors within sub-divisions of space on the basis of directivity information related to each sub-divisions of space,
- for each sub-division of space, determining directional sound activity level within said sub-division of space by summing said contributions within said sub-division of space, and a visualizing unit for displaying a visualization of the directional sound activity of the multichannel audio signal.

BRIEF DESCRIPTION OF THE DRAWINGS

Other aspects, objects and advantages of the present invention will become better apparent upon reading the following detailed description of preferred embodiments thereof, given as a non-limiting example, and made with reference to the appended drawings wherein.

DETAILED DESCRIPTION OF THE INVENTION

Figure 2:
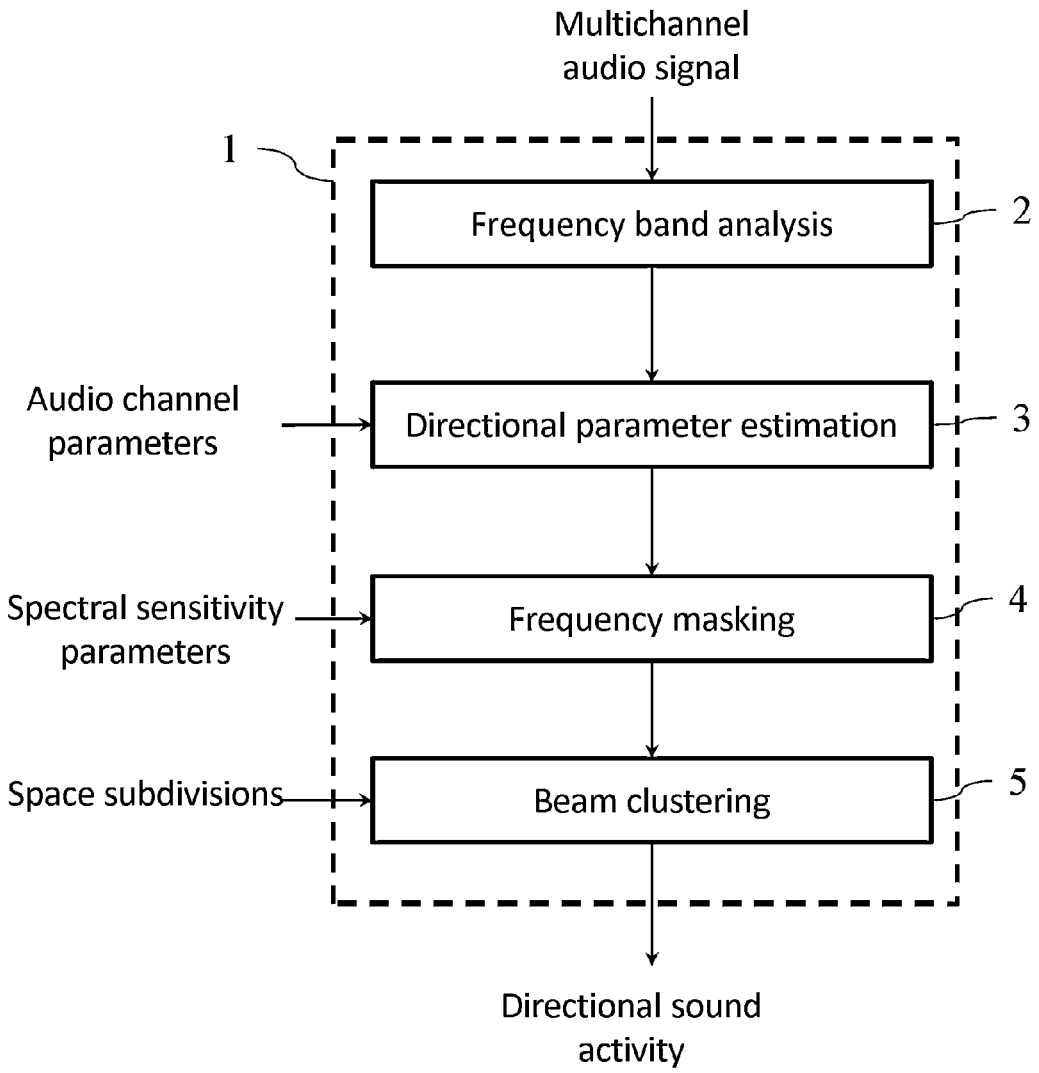
FIG. 2 is a block diagram of a directional sound activity analyzing unit showing a general overview of the processes in accordance with an embodiment of the present invention.

A directional sound activity analyzing unit 1 is illustrated in FIG. 2. The directional sound activity analyzing unit 1 is part of a device comprising a processor, typically a computer, further provided with means for acquiring audio signals and means for displaying a visualization of sound activity data, for example visual display unit such as a screen or a computer monitor. The directional sound activity analyzing unit 1 comprises means for executing the described method, such as a processor or any computing device, and a memory for buffering signals or storing various process parameters.

The directional sound activity analyzing unit 1 receives an input signal constituted by a multichannel audio signal. This multichannel audio signal comprises K audio channels, and each channel is associated with spatial information. Spatial information describes the location of the associated loudspeaker relative to the listener's location. For example, spatial information can be coordinates or angles and distances used to locate a loudspeaker with respect to a reference point, generally a listener's recommended location. Typically three values per audio channel are provided to describe this localization. Spatial parameters constituting said spatial information may then be represented by a K×3 matrix.

The directional sound activity analyzing unit 1 receives these input audio channels, and then determines directional sound activity levels to be displayed for visualizing the directional sound activity of a multichannel audio signal. The directional sound activity analyzing unit 1 is configured to perform the steps of the above-described method. The method is performed on a extracted part of the input signal corresponding to a temporal window. For example, a 50 ms duration analysis window can be chosen for analyzing the directional sound activity within said window.

First, a frequency band analysis 2 aims at estimating the sound activity level for a predetermined number of frequency sub-bands for each channel of the windowed multichannel audio signal.

For each channel, a sound activity level is determined for each one of said plurality of frequency sub-bands by performing a time-frequency transformation. The time-frequency transformation can be performed through a Fast Fourier Transformation (FFT).

The temporal windowing stage and the time-frequency transformation can be performed within a Short-Time Fourier Transformation (STFT) framework.

The frequency sub-bands are subdivisions of the frequency band of the audio signal, which can be divided into sub-bands of equal widths or preferably into sub-bands whose widths are dependent on human hearing sensitivity to the frequencies of said sub-bands.

The input channel signals $x_k[n]$ are windowed time-domain signals, wherein n is a time index. The channel index k identifies a channel of the multichannel audio signal. These time-domain channel signals $x_k[n]$ are then converted into frequency-domain signals $X_k[l]$, wherein l is a frequency index identifying a frequency sub-band. Accordingly, for each channel and frequency sub-band, a sound activity level is determined.

Then the directional parameter estimation 3 aims at estimating, for each frequency sub-band, the dominant sound direction that a listener would perceive if he were listening to the multichannel audio on an appropriate loudspeaker layout, i.e. corresponding to the recommended loudspeaker configuration in accordance with the multichannel audio format.

Accordingly, for each one of a plurality of frequency sub-bands, a directional sound activity vector is then estimated.

First, for each channel and frequency sub-band, a sound activity vector related to said channel is determined from the sound activity level related to said channel and frequency sub-band and from spatial information associated with said channel.

A channel configuration, i.e. the associated loudspeaker recommended positions corresponding to the signal coding, can be described by unit vectors $\vec{u}_k$ corresponding to the direction of the sound that would be emitted by loudspeakers fed by said channels. For example, three values describing this direction for each channel can constitute the required spatial information.

Accordingly, for a channel and for a frequency sub-band, a sound activity vector can be formed by associating the sound activity level corresponding to the frequency-domain signal $X_k[l]$ of said channel and said sub-band to the unit vector $\vec{u}_k$ corresponding to the spatial information associated with said channel.

Several methods can be used. For instance, the method presented hereafter is based on Gerzon's energy vectors. The sound activity vector related to one channel and one frequency sub-band can be expressed as:

$$\vec{E}_k[l]=|X_k[l]|^2\cdot\vec{u}_k$$

In this case, sound activity level is directly linked to the sound energy.

Then, for each frequency sub-band, the sound activity vectors related to the channels for said frequency sub-band are combined to obtain a directional sound activity vector related to said frequency sub-band.

For example, using Gerzon's energy vectors, the directional sound activity vector related to one frequency sub-band can be calculated as a mere summation of the sound activity vectors related to the channels for said frequency sub-band:

$$\vec{E}[l]=\sum_{k=1}^{K}\vec{E}_k[l]$$

This directional sound activity vector represents the predominant sound direction that would be perceived by a listener according to the recommended loudspeaker layout for sounds within that particular frequency sub-band.

An optional, however advantageous, frequency masking 4 can adapt directional sound activity vectors according to their respective frequency sub-bands. In order to tune reactivity with respect to sound frequencies, the norms of the directional sound activity vectors can be weighted based on their respective frequency sub-bands. The weighted directional sound activity vector is then $$\vec{G}[l]=\alpha[l]\cdot\vec{E}_k[l]$$

where $\alpha[l]$ is a weight, for instance between 0 and 1, which depends on the frequency sub-band of each directional sound activity vector. Such a weighting allows enhancing particular frequency sub-bands of particular interest for the user. This feature can be used for discriminating sounds based on their frequencies. For instance, frequencies related to particularly interesting sounds can be enhanced in order to distinguish them from ambient noise. The directional sound analyzing unit 1 can be fed with spectral sensitivity parameters which define the weight attributed to each frequency sub-band.

Figure 1:
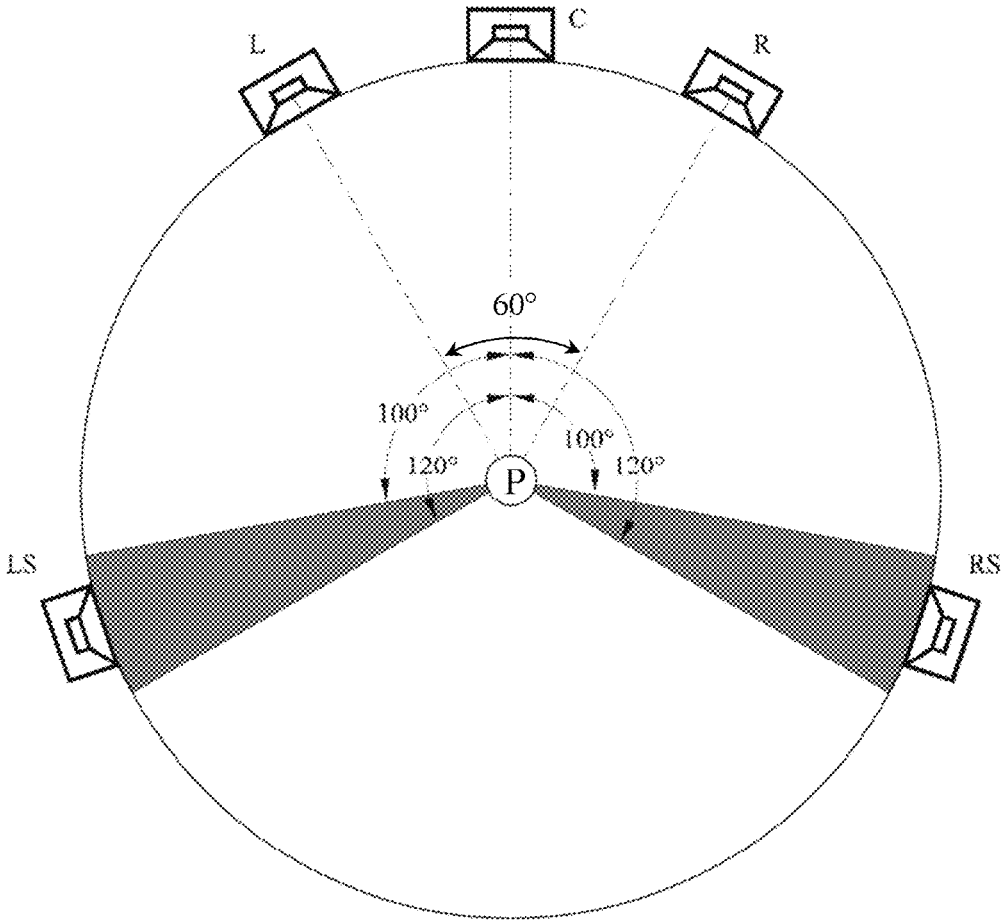
FIG. 1 shows a typical loudspeaker layout for multichannel audio system.
Figure 3:
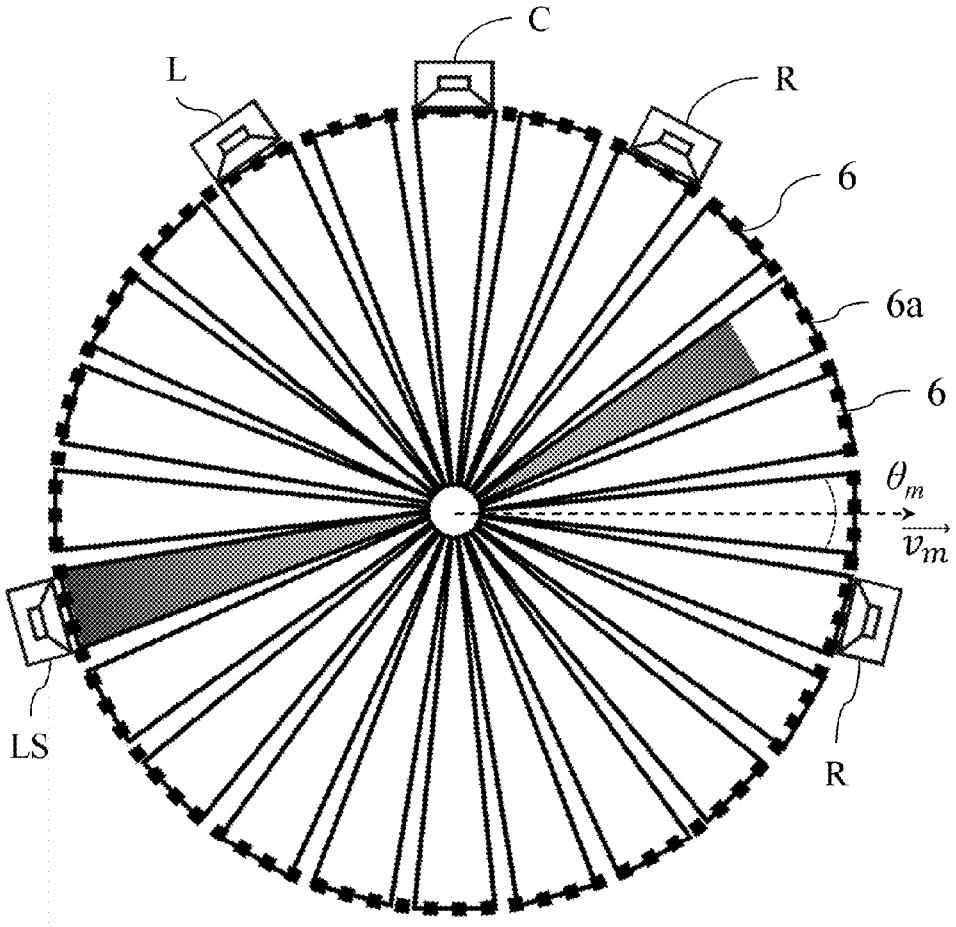
FIG. 3 illustrates a display layout according to an embodiment of the present invention.

In order to directionally visualize sound activity, space is divided into sub-divisions which are intended to discretely represent the acoustic environment of the listener. FIG. 3 shows an example of such a divided space relative to a 5.1 loudspeaker layout. A polar representation of the listener's environment is divided into M similar sub-divisions 6 circularly disposed around a central position representing the listener's location. Loudspeakers of the recommended layout of FIG. 1 are represented for comparison.

For each frequency sub-band, the dominant sound direction and the sound activity level associated to said direction is now determined and described by the directional sound activity vector, preferably weighted as described above. The visualization of such directional information must be very intuitive so that sound direction information can be restituted to the user without interfering with other source of information.

The beam clustering stage 5 corresponds to allocating to each of the sub-division a part of each frequency sub-band sound activity.

To this end the contributions of each frequency sub-band sound activity to each sub-division of space are determined on the basis of directivity information. For each sub-division of space, a directional sound activity level is determined within said sub-division of space by combining, for instance by summing, the contributions of said frequency sub-band sound activity to said sub-division of space.

Directivity information is associated to each sub-division 6. Such directivity information relates to level modulation as a function of direction in an oriented coordinate system, typically centered on a listener's position. This directivity information can be described by a directivity function which associates a weight to space directions in an oriented coordinate system. Typically, such a directivity function exhibits a maximum for a direction associated with the related sub-division.

For each sub-division 6 of space, norms of directional sound activity vectors are weighted on the basis of a directivity information associated with said sub-division 6 of space and the directions of said directional sound activity vectors. These weighted norms can thus represent the contribution of said directional sound activity vectors within said sub-divisions of space.

For instance, a directivity function can be parameterized by a beam vector $\vec{v}_m$ and an angular value $\theta_m$ corresponding to the angular width of the beam, wherein m identifies a space sub-division. The direction associated with a sub-division 6 can be the main direction defined by the beam vector $\vec{v}_m$. Accordingly, the angular distance between a beam vector $\vec{v}_m$ and a directional sound activity vector $\vec{G}[l]$ can define the clustering weight $C_m[l]$. For instance, a simple directional weighting function may be 1 if the angular distance between a beam vector $\vec{v}_m$ and a directional sound activity vector $\vec{G}[l]$ is less than $\theta_m/2$ and 0 otherwise:

$$C_m[l]=\begin{cases}1 \text{ if } \operatorname{angle}\left(\vec{v}_m,\vec{G}[l]\right)\le\theta_m/2\\ 0 \text{ if } \operatorname{angle}\left(\vec{v}_m,\vec{G}[l]\right)>\theta_m/2\end{cases}$$

The beam vector $\vec{v}_m$ and the angular value $\theta_m$ used for define the parameters of the directivity function can constitute an example of directivity information by which contribution of each one of said directional sound activity vectors within sub-divisions of space can be estimated.

The directional sound activity within a beam or sub-division of space can then be determined by summing said contributions, such as weighted norms in this example, of said directional sound activity vectors related to the L frequency sub-bands:

$$A_m=\sum_{l=1}^{L}C_m[l]\|\vec{G}[l]\|$$

Once determined, the directional sound activity for each of the M beam can be fed to a visualizing unit, typically to a screen associated with the computer which comprises or constitutes the directional sound analyzing unit 1.

For every space sub-division 6, such as the beams illustrated in FIG. 3, directional sound activity can then be displayed for visualization. A graphical representation of directional sound activity level within said sub-division of space is displayed, as in FIG. 3. In the displayed graphical representation, sub-divisions of space are organized according to their respective location within said space, so as to reconstruct the divided space.

FIG. 3 shows a configuration wherein the directional sound activity is restricted in two different beams, suggesting that virtual sound sources are located in the directions related to these two beams. It shall be noted that at least one beam 16*a* shows a directional sound activity without having a direction that corresponds to a loudspeaker recommended orientation. As can be seen, a user can easily and accurately infer sound source directions, and thus can retrieve sound direction information originally conveyed by the multichannel audio input signal.

Other graphical representation can be used, such a radar chart wherein directional sound activity levels are represented on axes starting from the center, lines or curves being drawn between the directional sound activity levels of adjacent axes. Preferably, the lines or curves define a colored geometrical shape containing the center.

The invention thus allows sound direction information to be delivered to the user even if said user does not possess the recommended loudspeaker layout, for example with headphones. It can also be very helpful for hearing-impaired people or for users who must identify sound directions quickly and accurately.

Preferably, the graphical representation shows several directional sound activity levels for each sub-division, these directional sound activity levels being calculated with different frequency masking parameters.

For example, at least two set of spectral sensitivity parameters are chosen to parameterize two frequency masking process respectively used in two directional sound activity level determination processes. The two set of directional sound activity vectors determined from the same input audio channels are weighted based on their respective frequency sub-bands in accordance with two different set of weighting parameters.

Consequently, for each sub-division, each one of the two directional sound activity levels enhanced some particular frequencies in order to distinguish different sound types. The two directional sound activities can then be displayed simultaneously within the same sub-divided space, for example with a color code for distinguishing them and a superimposition, for instance based on level differences.

The method of the present invention as described above can be realized as a program and stored into a non-transitory tangible computer-readable medium, such as CD-ROM, ROM, hard-disk, having computer executable instructions embodied thereon that, when executed by a computer, perform the method according to the invention.

While the present invention has been described with respect to certain preferred embodiments, it will be apparent to those skilled in the art that various changes and modifications may be made without departing from the scope of the invention as defined in the appended claims.

What is claimed is:

1. A method for visualizing a directional sound activity of a multichannel audio signal, comprising:

receiving input audio channels, spatial information being associated with each channel of said multichannel audio signal, performing a time-frequency transformation of said input audio channels, for each one of a plurality of frequency sub-bands, determining a directional sound activity vector from said transformed input audio channels, wherein said sound activity vector of a frequency sub-band associates sound activity levels of said transformed input audio channels within said frequency sub-band to spatial information associated with said channels of said multichannel audio signal, determining a contribution of each one of said directional sound activity vectors within sub-divisions of space on the basis of directivity information related to each sub-divisions of space, for each sub-division of space, determining directional sound activity level within said sub-division of space by summing said contributions within said sub-division of space, displaying a visualization of the directional sound activity of the multichannel audio signal by a graphical representation of directional sound activity level within said sub-divisions of space.

2. The method of claim 1, wherein determining the directional sound activity vector for a frequency sub-band comprises:

for each channel, determining a sound activity level for said frequency sub-band from the transformed input audio channel, for each channel, determining a sound activity vector related to said channel from the sound activity level and spatial information associated with said channel and, combining the sound activity vectors related to the channels for said frequency sub-band to obtain the directional sound activity vector related to said frequency sub-band.

3. The method of claim 2, wherein time-frequency transformation is performed through a short-time Fourier transform.

4. The method of claim 1, wherein directional information used for determining the contribution of a directional sound activity vector within a sub-division of space is an angular distance between a direction associated with said sub-division of space and the direction of said directional sound activity vector.

5. The method according to claim 1, wherein the contribution of a directional sound activity vector within a sub-division of space is determined by weighting a norm of said directional sound activity vector on the basis of an angular distance between a direction associated with said sub-division of space and the direction of said directional sound activity vector.

6. The method of claim 1, wherein spatial information comprises spatial parameters describing a location of loudspeakers relative to a listening position according to a recommended configuration.

7. The method of claim 1, wherein norms of the directional sound activity vectors are further weighted based on their respective frequency sub-bands.

8. The method of claim 7, wherein at least two set of directional sound activity vectors determined from the same input audio channels are weighted based on their respective frequency sub-bands in accordance with two different set of weighting parameters, and the two resulting directional sound activities are displayed on the graphical representation.

9. The method of claim 1, wherein the visualization of the directional sound activity of the multichannel audio signal comprises representations of said sub-division of space, each provided with a representation of the directional sound activity associated with said sub-division.

10. A non-transitory tangible computer-readable medium having computer executable instructions embodied thereon that, when executed by a computer, perform the method for visualizing directional sound activity of a multichannel audio signal, said method comprising:

receiving input audio channels, spatial information being associated with each channel of said multichannel audio signal, performing a time-frequency transformation of said input audio channels, for each one of a plurality of frequency sub-bands, determining a directional sound activity vector from said transformed input audio channels, wherein said sound activity vector of a frequency sub-band associates sound activity levels of said transformed input audio channels within said frequency sub-band to spatial information associated with said channels of said multichannel audio signal, determining a contribution of each one of said directional sound activity vectors within sub-divisions of space on the basis of directivity information related to each sub-divisions of space;

for each sub-division of space, determining directional sound activity data within said sub-division of space by summing said contributions within said sub-division of space; displaying a visualization of the directional sound activity of the multichannel audio signal.

11. The non-transitory tangible computer-readable medium of claim 10, wherein for determining the sound activity vector for a frequency sub-band, the method comprises:

for each channel, determining a sound activity level for said frequency sub-band, for each channel, determining a sound activity vector related to said channel from the sound activity level and spatial information associated with said channel and, combining the sound activity vectors related to the channels for said frequency sub-band to obtain the directional sound activity vector related to said frequency sub-band.

12. The non-transitory tangible computer-readable medium of claim 10, wherein norms of the directional sound activity vectors are further weighted based on their respective frequency sub-bands.

13. An apparatus for visualizing directional sound activity of a multichannel audio signal, comprising:

a directional sound analyzing unit, comprising means for receiving input audio channels, spatial information being associated with each channel of said multichannel audio signal, performing a time-frequency transformation of said input audio channels, for each one of a plurality of frequency sub-bands, determining a directional sound activity vector from said transformed input audio channels, wherein said sound activity vector of a frequency sub-band associates sound activity levels of said transformed input audio channels within said frequency sub-band to spatial information associated with said channels of said multichannel audio signal, determining a contribution of each one of said directional sound activity vectors within sub-divisions of space on the basis of directivity information related to each sub-divisions of space, for each sub-division of space, determining directional sound activity data within said sub-division of space by summing said contributions within said sub-division of space, a visualizing unit for displaying a visualization of the directional sound activity of the multichannel audio signal.

14. The apparatus of claim 13, wherein for determining the directional sound activity vector for a frequency sub-band, the directional sound analyzing unit further comprises means for for each channel, determining a sound activity level for said frequency sub-band from the transformed input audio channel, for each channel, determining a sound activity vector related to said channel from the sound activity level and spatial information associated with said channel and, combining the sound activity vectors related to the channels for said frequency sub-band to obtain the directional sound activity vector related to said frequency sub-band.

15. The apparatus of claim 13, further comprising means for weighting norms of the directional sound activity vectors on the basis of their respective frequency sub-bands.

* * * * *